United States Patent [19]

Bloom

[11] 4,049,372

[45] Sept. 20, 1977

[54] APPARATUS FOR SUPPORTING AND REMOVING A WORK SUPPORTING ROLL

[75] Inventor: William M. Bloom, Pittsburgh, Pa.

[73] Assignee: Allegheny Ludlum Industries, Inc., Pittsburgh, Pa.

[21] Appl. No.: 683,103

[22] Filed: May 4, 1976

[51] Int. Cl.[2] ..... F27D 3/00; F27D 7/00; F27B 9/28

[52] U.S. Cl. ..... 432/246; 432/3; 432/59; 432/65

[58] Field of Search ..... 432/3, 65, 236, 246, 432/59, 60

[56] References Cited

U.S. PATENT DOCUMENTS

| | | | |
|---|---|---|---|
| 494,904 | 4/1893 | Story | 72/226 |
| 2,638,333 | 5/1953 | Hess | 432/65 |
| 2,872,174 | 2/1959 | Lindquist | 432/3 |
| 3,528,268 | 9/1970 | Roberts | 432/59 |

*Primary Examiner*—John J. Camby
*Attorney, Agent, or Firm*—Vincent G. Gioia; Robert F. Dropkin

[57] ABSTRACT

A furnace work supporting roll and a spare work roll are mounted on a frame in diametrically opposed positions with the spare roll normally out of the furnace. The frame is mounted on an axis parallel to the roll axis and equal distance therefrom. A water cooled shield is mounted on the frame between the rolls to protect the spare roll from the heat of the furnace and has an outer surface with a diameter equal to that between the outside of the rolls. To inspect and/or remove the work roll from the furnace, the frame is rotated so that the position of the rolls are reversed. A water cooled heat shield is provided at the ends of the diameter perpendicular to the diameter through the roll axes at a distance equal to that between the outside of the rolls. A roll supporting table beneath the position of the spare roll is movable toward and away from the frame.

9 Claims, 11 Drawing Figures water
water

VIII
VIII
XI
XI
50 and 52
6
8
15
16
16S
17
28
32
42
44
46
48
52
54
56
58
60

APPARATUS FOR SUPPORTING AND REMOVING A WORK SUPPORTING ROLL

This invention relates to apparatus for supporting and removing a work supporting roll from a furnace and more particularly to so supporting and removing a strip supporting roll in a horizontal continuous strip heating furnace. Prior to my invention each roll was supported on a frame having an axis parallel to the roll axis and a spare roll was mounted on the frame diametrically opposite to the strip supporting roll. The frame was such that the spare roll was subjected to the heat of the furnace and heat expansion of the upper roll housings often prevented rotation of the frame. Rolls commonly used are made of asbestos discs or other compressed refractories. Particles of steel slivers, etc. become embedded in the roll surface and must be removed as soon as possible to prevent continuing damage to the strip surface. When a defective roll was discovered the common practice was to stop the line, reduce the furnace temperature to a level that the workmen could stand, remove a section of the furnace above the roll, lift the strip off the roll, and remove the roll with a chain sling or C-hook porter bar. Even when the furnace is cooled down the temperature is still high so that the working conditions are very poor and do not permit roll inspection without removal of the roll from the furnace and the supporting frame. This is generally true even though the frame is rotated to bring the roll outside the furnace since the temperature at this position remains high because it is subject to the furnace heat so that it is necessary to use the spare roll. Thus inspection and/or replacement of the roll is an expensive and time consuming operation.

It is therefor an object of my invention to provide roll supporting and removal apparatus which permits ready inspection, minor repair and/or replacement of the roll without shutting down the furnace operation.

Another object is to provide such apparatus which enables a quick change of rolls when the type of workpiece is changed.

Still another object is to provide such apparatus which permits the workmen to work more efficiently under more comfortable and safer conditions.

A still further object is to provide such apparatus which reduces heat loss from the furnace during roll use and yet allows quick change of the furnace roll.

These and other objects will be more apparent after referring to the following specification and attached drawings in which.

Figures 1, 2, 3, 4, 5, 6:
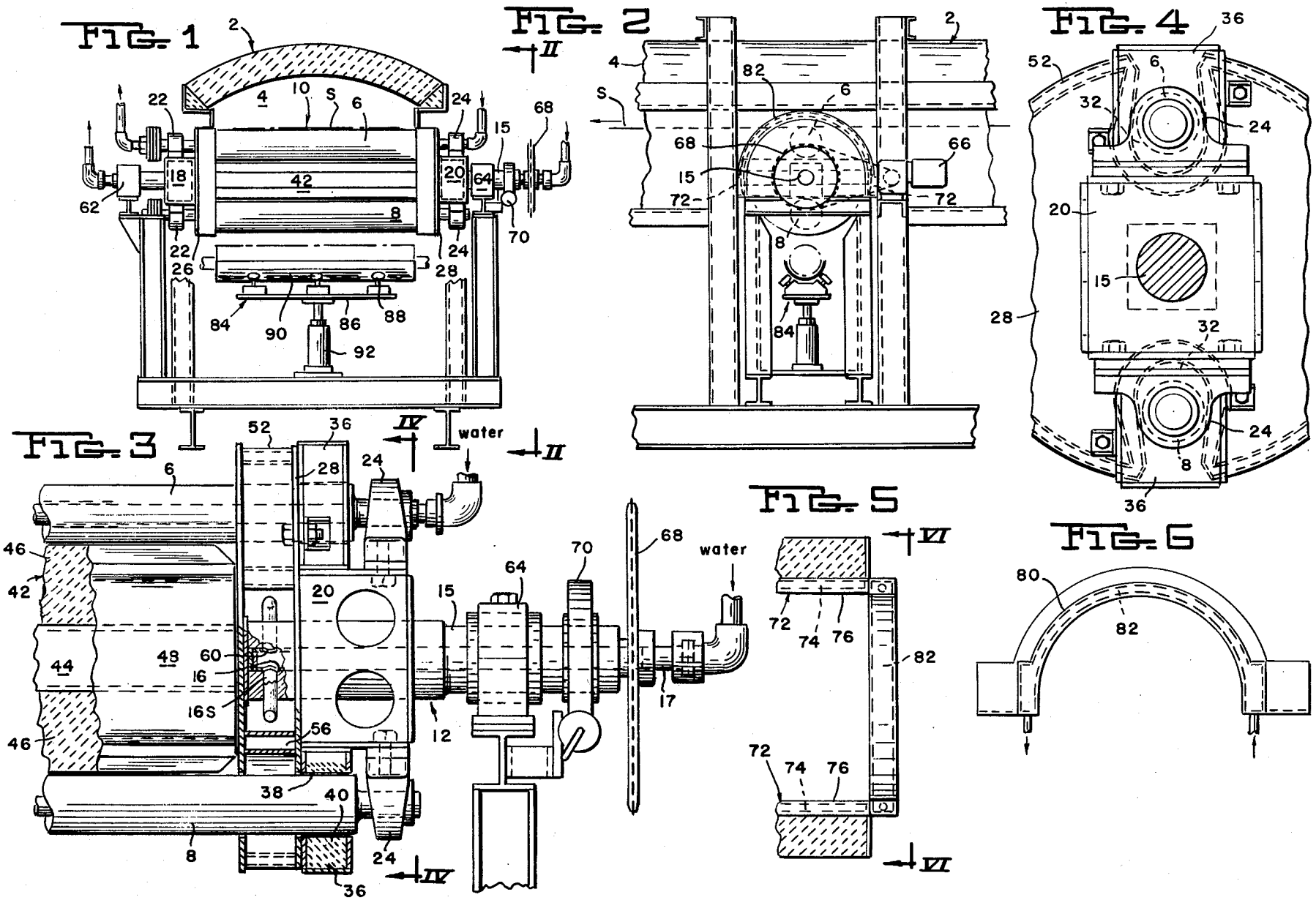
FIG. 1 is a transverse elevation, partly in section, of a furnace having my invention incorporated therein.
FIG. 2 is a view taken on line II—II of FIG. 1.
FIG. 3 is an enlarged view, partly in section, of a portion of FIG. 1 and showing my invention in more detail.
FIG. 4 is a view taken on line IV—IV of FIG. 3.
FIG. 5 is a partial view of a stationary heat shield used with my invention.
FIG. 6 is a view taken on line VI—VI of FIG. 5.
Figures 7, 8, 9, 10, 11:
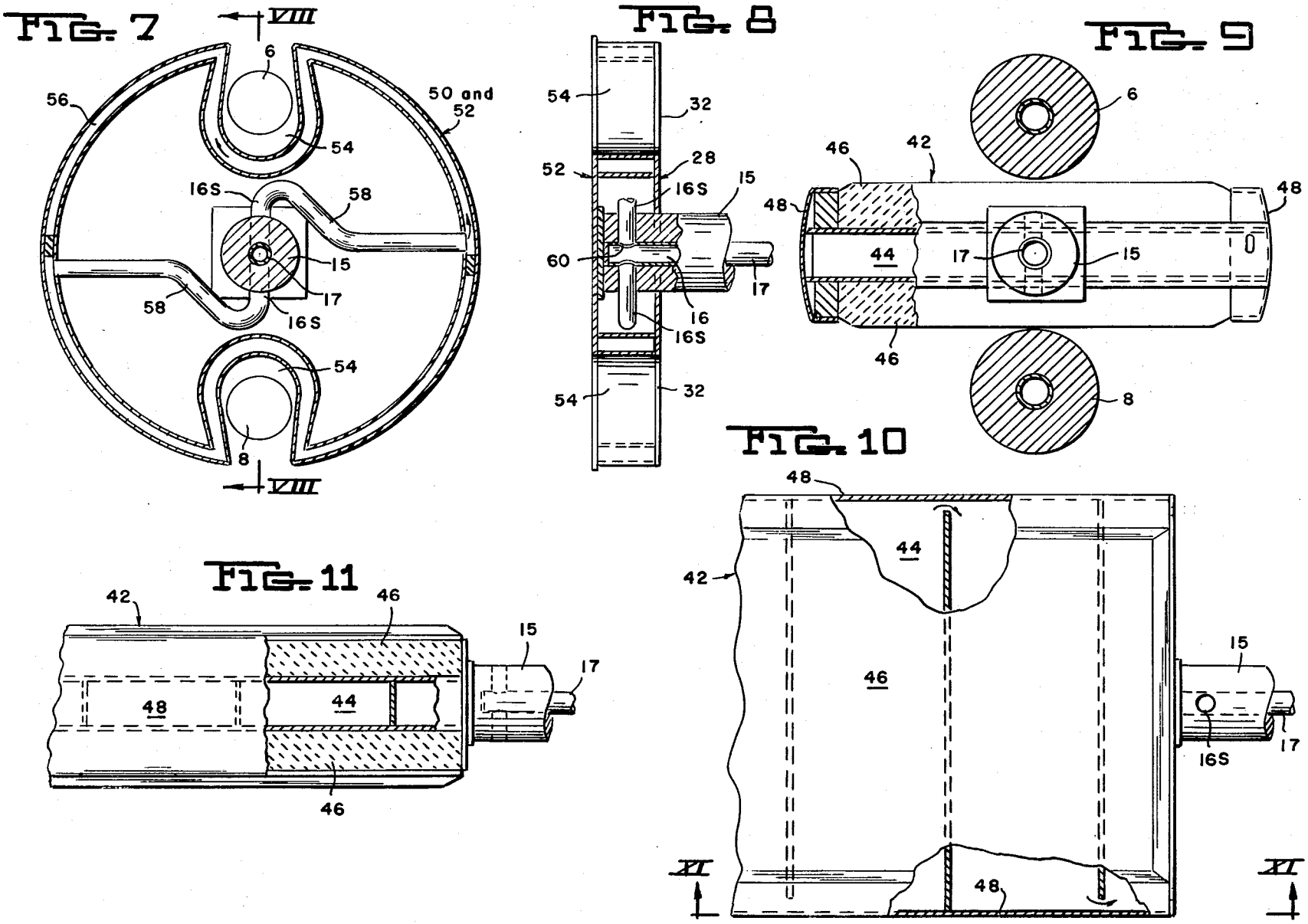
FIG. 7 is a transverse sectional view of a portion of the rotary heat shield of my invention.
FIG. 8 is a view taken on line VIII—VIII of FIG. 7.
FIG. 9 is a transverse elevation, partly in section, of another portion of the rotary heat shield of my invention.
FIG. 10 is an enlarged transverse view, partly in section, of an element of FIG. 9.
FIG. 11 is a view taken on line XI—XI of FIG. 10.

Referring more particularly to FIGS. 1 and 2 of the drawings reference numeral 2 indicates a furnace having a heating chamber 4. A strip S passes through the heating chamber over spaced apart rolls 6, only one of which is shown. The roll 6 together with a spare roll 8 is mounted on a rotatable water cooled roll table 10. The table 10 includes a shaft assembly consisting of two axially aligned shafts 15 spaced about 6 feet apart in one particular installation. Each shaft has an axial hole 16 therein and a transverse hole 16S at its inner end. A stationary tube 17 is positioned in each hole 16 with a water seal between the tube and hole. Roll bearing supports 18 and 20 are welded or otherwise fastened to shafts 14 and 15, respectively, and support pairs of bearings 22 and 24, respectively. The top bearings 22 and 24 are aligned and support roll 6 and the bottom bearings 22 and 24 are aligned and support roll 8. Shield plates 26 and 28 are secured to shafts 14 and 15, respectively. Only shield plate 28 is shown in detail since both plates have the same construction. Shield plate 28 has diametrically opposed slots 32, aligned with similar slots in shield plate 26 for passage of rolls 6 and 8. Each shield plate supports diametrically opposed roll shields 36 as best shown in FIG. 3 which shows the right side of the table 10. The left side of the table is similarly constructed. The shields have roll openings 38 therein surrounded by insulation 40 such as KAOWOOL blankets. Attached to and extending between the adjacent ends of shafts 15 is a water cooled shield 42 shown in detail in FIGS. 9 to 11 and having a central cooling chamber 44 surrounded by top and bottom layers of insulation 46 such as KAOWOOL. The shield 42 includes arcuate outer portions 48 which have their axis on the axis of shaft assembly 12 and a diameter equal to the distance between the outer parts of rolls 6 and 8. Water cooling rings 50 and 52 are attached to and surround shield plates 26 and 28 respectively. Each ring has a pair of openings 54 for receiving rolls 6 and 8. Each ring includes a peripheral water chamber 56 connected by piping 58 to side outlet 16S from axial holes 16. The remainder of the inside of the ring is filled with insulation.

Shafts 15 are supported in bearings 62 and 64. The right side shaft 15 is rotated by motor 66 (FIG. 2) through sprocket 68 attached to its outer end. A brake 70 surrounds shaft 15 between bearing 64 and sprocket 68.

A heat shield 72 (FIGS. 2, 5 and 6) is provided on the furnace 2 one on each side of each table 10 when supporting intermediate support rolls 6 and one on the furnace side when supporting an end roll. Each heat shield 72 includes a water chamber 74 backed by the furnace refractory. The outer surface 76 of the heat shield is arcuate and mates with the arcuate outer portion 48 of the roll table when the roll 6 is in operative position so as to prevent escape of heat and combustion gases from the furnace. A curved heat shield 80 is also provided at each end of the roll table 10 to prevent escape of heat and combustion gases and is provided with a cooling water chamber 82. All four shields may be structurally connected or separate.

A roll lift table 84 (FIGS. 1 and 2) is mounted below roll 8 in the vertical plane through its axis. The table 84 includes a platform 86 carring rolls 88 which support a semi-circular pan 90 which in turn receives the roll. A hydraulic motor 92 raises and lowers the platform.

In operation, with strip S passing through the furnace, heat is prevented to a great extent from heating the roll 8. Water flows into the tube 17 of the right side shaft 15 and then through a hole 60 in the tube 17 which faces upwardly so that the water is discharged into the upper portion of transverse hole 16S. From here the water passes through one section of piping 58 to the upper half of water chamber 56 and then to the adjacent end of cooling chamber 44. The water is discharged from chamber 44 in the reverse manner through the cooling chambers of the other shaft. Water enters and leaves the tubes 16 of shafts 15 through a rotary coupling or other water seal (not shown). When it is desired to examine or replace the roll 6 this can be done when the furnace is running by rotating the table 10 so that its surface moves in the direction of strip travel. The outer periphery of the table itself will support the strip until roll 8 reaches its operative position. It will be seen that shaft 15 rotate about their tubes 16 so that water can remain on during the table rotation, but flow discontinues until the table rotates through 180°. At that time the outlet 60 will be in communication with the other portion of transverse hole 16S and the other section of piping 58. The flow of water will then be the same as before except that the original lower portion of the water chamber 56 will be uppermost and the water will flow through it. The roll 6, being protected from the heat of the furnace, cools rather quickly so that it can be examined in place or removed from the table 10 by operation of lift table 84. In some instances particles of steel slivers or other material embedded in the roll may be readily removed or other damage to the roll may be quickly taken care of and the roll returned to service. In those instances when the roll is beyond repair or may require extensive work to repair it, it can be quickly removed and replaced by another spare roll. In any case the inspection and/or replacement of a roll can be made in a much shorter time than previously.

While one embodiment has been shown and described in detail, it will be readily apparent to those skilled in the art that various adaptations and modifications may be made within the scope of the invention.

I claim:

1. Apparatus for supporting and removing a work supporting roll from a furnace comprising a rotatable shaft assembly, spaced apart bearings for supporting said rotatable shaft assembly about an axis parallel to that of the work supporting roll, a first pair of spaced apart bearings mounted on said shaft for rotatably supporting said work supporting roll, a second pair of spaced apart bearings mounted on said shaft diametrically opposed to said first pair for rotatably supporting a spare work supporting roll, a water cooled shield supported by said shaft assembly between said work supporting rolls, said water cooled shield having a water cooling chamber and insulation surrounding said cooling chamber and extending the length thereof, said shield having circular segmental side portions having a radius extending from the axis of said shaft assembly a distance substantially equal to that from the axis of said shaft assembly to the outermost part of said rolls, and means for rotating said shaft assembly.

2. Apparatus according to claim 1 including a stationary heat shield supported on said furnace and adapted to be in close engagement with one of said circular segmental side portions when said work supporting roll is in operative position.

3. Apparatus according to claim 2 in which the axes of said rolls and shaft assembly are generally horizontal, and said apparatus includes a roll supporting table below said spare roll, and means for moving said table vertically between an upper position in which said spare roll can be engagedwhile supported in its bearings and a lower position in which said spare roll can be supported out of the path of rotation of said water cooled shield.

4. Apparatus for supporting and removing a work supporting roll from a furnace comprising a pair of axially aligned shafts spaced apart at their inner ends, spaced apart bearings below said work supporting roll one for supporting each of said shafts for rotation about a generally horizontal axis, an upper and lower bearing support mounted on each shaft, a bearing mounted on each bearing support, said work supporting roll being mounted in the top bearings, a spare work supporting roll mounted in the lower bearings, a shield plate mounted on each of said shafts inwardly of said bearing supports, said sheild plate having openings therein for said rolls, roll shields including insulation surrounding each of said rolls and mounted on said shield plates on the outboard side thereof, a water cooled shield attached to and extending between the ends of said shafts, said water cooled shield having a water cooling chamber and insulation surrounding said cooling chamber and extending the length thereof, said shield having circular segmental side portions with a radius extending from the axes of said shafts a distance substantially equal to that from the axes of said shafts to the outermost part of each of said rolls, a water cooling ring attached to the inner side of each of said shield plates and having a peripheral water chamber and insulation therein, means for supplying water to said water chambers, and means for rotating one of said shafts.

5. Apparatus according to claim 4 including a stationary heat shield supported on said furnace and adapted to be in close engagement with one of said circular segmental side portions when said work supporting roll is in operative position.

6. Apparatus according to claim 5 including a roll supporting table below said spare roll, and means for moving said table vertically between an upper position in which said spare roll can be engaged while supported in its bearings and a lower position in which said spare roll can be supported out of the path of rotation of said water cooled shield.

7. Apparatus according to claim 4 in which said means for supplying water to said water chambers includes an axial hole in each of said shafts, said outlets from said axial holes adjacent the inner ends thereof, piping from said side outlets to said peripheral water chambers, connections between said peripheral water chambers and the water cooling chamber of said water cooled shield.

8. Apparatus according to claim 7 including a stationary heat shield supported on said furnace and adapted to be in close engagement with one of said circular segmental side portions when said work supporting roll is in operative positions.

9. Apparatus according to claim 8 in which said means for supplying water to said water chambers includes an axial hole in each of said shafts, side outlets from said axial adjacent the inner ends thereof, piping from said side outlets to said peripheral water chambers, connections between said peripheral water chambers and the water cooling chamber of said water cooled shield.

* * * * *